US005638043A

United States Patent [19]

Sakai et al.

[11] Patent Number: 5,638,043

[45] Date of Patent: Jun. 10, 1997

[54] WARNING APPARATUS

[75] Inventors: Masayoshi Sakai; Koichi Futsuhara, both of Urawa, Japan

[73] Assignee: The Nippon Signal Co., Ltd.,, Tokyo, Japan

[21] Appl. No.: 666,424

[22] PCT Filed: Nov. 14, 1994

[86] PCT No.: PCT/JP94/01924

§ 371 Date: Jun. 18, 1996

§ 102(e) Date: Jun. 18, 1996

[87] PCT Pub. No.: WO96/15513

PCT Pub. Date: May 23, 1996

[30] Foreign Application Priority Data

Nov. 4, 1993 [JP] Japan ..... 5-275686

[51] Int. Cl.[6] ..... G08B 3/10

[52] U.S. Cl. ..... 340/384.6; 340/384.4; 340/514

[58] Field of Search ..... 340/384.4, 384.5, 340/384.6, 384.7, 532, 506, 692, 511; 381/55, 56, 58, 59, 77, 96; 367/197, 198, 199

[56] References Cited

U.S. PATENT DOCUMENTS 3,656,158 4/1972 Goodwater ..... 340/409

4,554,533 11/1985 Bosnak ..... 381/59

FOREIGN PATENT DOCUMENTS 60-219900 11/1985 Japan .
1-135898 9/1989 Japan .
2-161893 6/1990 Japan .
2-168394 6/1990 Japan .
5-328499 12/1993 Japan .
63-95397 6/1996 Japan .

*Primary Examiner*—Jeffery Hofsass
*Assistant Examiner*—Anh La
*Attorney, Agent, or Firm*—Reid & Priest LLP

[57] ABSTRACT

The present invention relates to a warning apparatus which can continuously monitor a normal condition wherein an alarm sound can be produced. When a high level judgement signal (W) indicating safety is input, an inaudible frequency signal is supplied from a V-F converter (11) to a speaker (13) so that a warning sound of an inaudible frequency is generated, while when a low level (zero) judgement signal (W) indicating danger is input, an audible frequency signal is supplied from the V-F converter (11) to the speaker (13) so that a warning sound of an audible frequency which can be heard by personnel is generated. Furthermore, when an output current of an inaudible frequency or an audible frequency is supplied to the speaker (13), the output current is sampled by a current transformer (21) of a monitoring circuit (20), and amplified and rectified to give a direct current output signal (SN), thereby enabling verification that the warning apparatus is normal.

7 Claims, 4 Drawing Sheets

WARNING APPARATUS

TECHNICAL FIELD

The present invention relates to a warning apparatus which generates a warning sound for warning of a dangerous situation when this arises.

BACKGROUND ART

To warn nearby people of danger, for example when a train is approaching a railway crossing, or when an abnormal situation arises in a factory or the like, in general a warning sound is produced using a siren, a bell or the like. More recently, a speaker or a piezoelectric buzzer has been used for producing the warning sound.

With such a conventional warning apparatus wherein a dangerous situation is notified by producing a warning sound, the warning apparatus is only driven to produce the warning sound when the dangerous situation arises, while at normal safe times, it is not driven so that the warning sound is not generated.

However, in particular at factories and the like, dangerous situations wherein the warning apparatus is operated seldom arise. Hence, it cannot be known if there is a fault in the warning apparatus. It is therefore uncertain if the warning apparatus can normally produce a warning sound when a dangerous situation actually arises, so that there is extreme danger to nearby personnel in the case of a fault such that the warning sound is not sounded.

The present invention takes into consideration the above situation with the object of providing a highly reliable warning apparatus which can verify if a warning sound can be produced, even at normal safe times where it is not necessary to warn personnel.

DISCLOSURE OF THE INVENTION

Accordingly, the warning apparatus according to the present invention comprises a warning sound generating circuit which generates a warning sound within an audible frequency range when a signal indicating danger is input thereto and which generates a warning sound within an inaudible frequency range when a signal indicating safety is input thereto, and a monitoring circuit for continuously monitoring for the presence of a warning sound from the warning sound generating circuit.

With such an arrangement, when a signal indicating danger is input, a warning sound within an audible frequency range is generated, while when a signal indicating safety where a danger warning is not required is input, then a warning sound within an inaudible frequency range is generated. Hence a warning sound is heard by personnel only when warning of danger, and is not heard at the time of safety. Consequently an audible warning sound is generated at the time of danger only, with no disturbing noise at the time of safety. Moreover since when normal, the warning sound generating circuit continuously generates a warning sound which is either within an audible frequency range or within an inaudible frequency range, then by monitoring with the monitoring circuit for the presence of this warning sound, it can be verified whether or not the warning sound generating circuit is normal. It is thus possible to avoid the situation wherein at the time of danger, a warning cannot be given due to a fault.

Basically, the warning sound generating circuit comprises a voltage-frequency converter which generates an audible frequency signal when a low level voltage signal indicating danger is input thereto, and which generates an inaudible frequency signal when a high level voltage signal indicating safety is input thereto, an amplifier for amplifying an output signal from the voltage-frequency converter, and a speaker for generating a warning sound based on the output signal from the amplifier; and the monitoring circuit comprises a current sensor for detecting an input current of the speaker, an amplifier for amplifying an output from the current sensor, and a rectifying circuit for rectifying an output from the amplifier.

Moreover, a microphone which receives an output sound from the speaker may be used instead of the current sensor.

Furthermore, a piezoelectric buzzer may be used instead of the speaker, with the output sound from the piezoelectric buzzer received by a microphone.

When a piezoelectric buzzer is used instead of the speaker, a lead wire may be connected to a vibration body of the piezoelectric buzzer, and the vibration of the vibration body taken out as an electrical signal by means of the lead wire and input to the amplifier of the monitoring circuit.

Moreover, if the monitoring circuit is constructed so as to generate a high level output when there is a warning sound from the warning sound generating circuit, and a low level output when there is no warning sound, then for example, the output from the monitoring circuit may be supplied to a lamp or the like, so that at normal times the lamp is illuminated, while at the time of a fault, the lamp is extinguished. In this way it can be easily verified from the illumination or extinguishing of the lamp, if the warning apparatus is normal or faulty.

Furthermore the voltage-frequency converter may be constructed so as to take a previously input bias voltage, and a judgement signal being a low level voltage signal when indicating danger and a high level voltage signal when indicating safety, and with a sum of the voltage level of the judgement signal and the bias voltage as an input voltage level, generate an output signal of a frequency corresponding to the input voltage level.

BEST MODE FOR CARRYING OUT THE INVENTION

As follows is a description of embodiments of the present invention with reference to the drawings.

Figure 1:
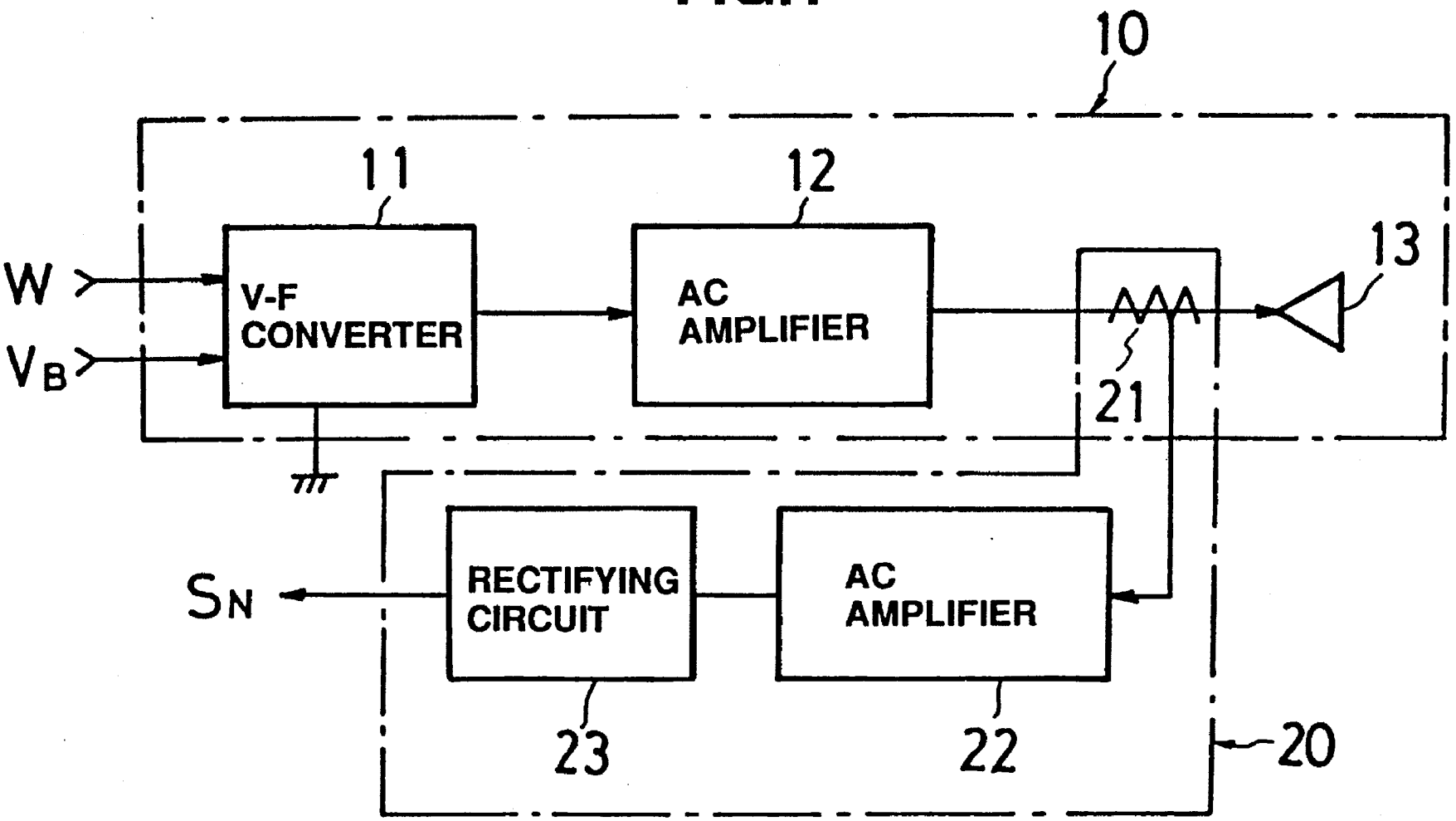
FIG. 1 is a structural diagram showing a first embodiment of a warning apparatus according to the present invention.

FIG. 1 shows a construction of a first embodiment of a warning apparatus according to the present invention.

As shown in FIG. 1, the warning apparatus of the first embodiment comprises a warning sound generating circuit 10 which, based on a voltage level of a judgement signal W from a judgement circuit (not shown in the figure) for judging a danger condition or a safe condition, generates a warning sound within an audible frequency range when the voltage level of the judgement signal W is a low level indicating danger (when there is no judgement signal W input), and generates a warning sound within an inaudible frequency range when the voltage level of the judgement signal W is a high level indicating safety (when there is a judgement signal W input) and a monitoring circuit 20 for continuously monitoring for the presence of either of the warning sounds from the warning sound generating circuit 10.

The warning sound generating circuit 10 comprises a voltage-frequency converter 11 (referred to hereunder as a V-F converter) into which is input the judgement signal W and a bias voltage VB of a lower voltage level than the judgement signal W, which generates a frequency signal corresponding to the input voltage value (the sum of the two voltage levels), an AC amplifier 12 for amplifying an output from the V-F converter 11, and a speaker 13 driven by an output from the AC amplifier 12 for generating a warning sound. The V-F converter 11 is a device such as V-F converter model No. AD652 made by the Analog Device Company, which generates an inaudible frequency signal (for example 20 KHz) when the input voltage is high, and an audible frequency signal (for example a few KHz) when the input voltage is low.

The monitoring circuit 20 comprises: a current transformer 21 serving as a current sensor for detecting the output current from the AC amplifier 12 which is input to the speaker 13, an AC amplifier 22 for amplifying an output from the current transformer 21, and a rectifying circuit 23 for rectifying an output from the AC amplifier 22.

As follows is a description of the operation of the warning apparatus of the above construction.

At first is a description of the operation at the time of danger. When a dangerous situation arises, the judgement signal W is not input (the voltage level corresponds to zero). In this case, the input voltage level of the V-F converter 11 is only the previously input bias voltage $V_B$, and thus becomes a low voltage level input. Therefore an output signal of an audible frequency is generated by the V-F converter 11. This output signal is then amplified by the AC amplifier 12 to drive the speaker 13, so that a warning sound of an audible frequency is generated from the speaker 13. Consequently, when a dangerous situation arises, the warning sound from the speaker 13 can be heard by personnel, so that they can be warned of the danger.

On the other hand, since at the time of safety, a judgement signal W (a voltage level greater than zero) is input, the input voltage level of the V-F converter 11 becomes the sum of the previously input bias voltage VB and the voltage level of the input judgement signal W, and thus becomes a high voltage level input. This may be achieved for example by a known method wherein the judgement signal W is made an alternating current signal, and this judgement signal W is clamped to the bias voltage $V_B$, and rectified using a voltage doubler rectifying circuit. As a result, an output signal of an inaudible frequency is generated by the V-F converter 11. This output signal is then amplified by the AC amplifier 12 to drive the speaker 13. In this way, a warning sound of an inaudible frequency is generated by the speaker 13 at the time of safety. However, since this warning sound can not be heard by personnel, there is no annoying noise.

Moreover, when a signal of either an audible frequency or an inaudible frequency is input from the AC amplifier 12 to the speaker 13, the input signal is received by the current transformer 21. This received signal is then amplified by the AC amplifier 22 and rectified by the rectifying circuit 23 so that a direct current output signal $S_N$ is generated by the monitoring circuit 20. Furthermore, if a fault occurs for example in any one of the V-F converter 11, the AC amplifiers 12 and 22, the current transformer 21 or the rectifying circuit 23, or a disconnection fault occurs in the coil or the lead of the speaker 13, then the direct current output signal $S_N$ is not generated.

Consequently, if for example a lamp is illuminated by the output signal $S_N$ from the monitoring circuit 20, then if a fault occurs in the warning sound generating circuit 10 or in the monitoring circuit 20, the lamp will be extinguished, and hence the occurrence of the fault in the warning apparatus can be known. It is thus possible to continuously verify whether or not the warning apparatus is in a normal condition wherein a warning can be generated.

With such a warning apparatus, it can be verified if the warning apparatus is normal even at the time of safety where it is not necessary to generate a warning. Hence the extremely dangerous situation for nearby personnel wherein at the time of danger, the warning apparatus cannot generate a warning due to a fault, can be avoided. Moreover, since the speaker 13 is not audibly sounded continuously but only at the time of danger, then there is no generation of an annoying noise.

Figure 2:
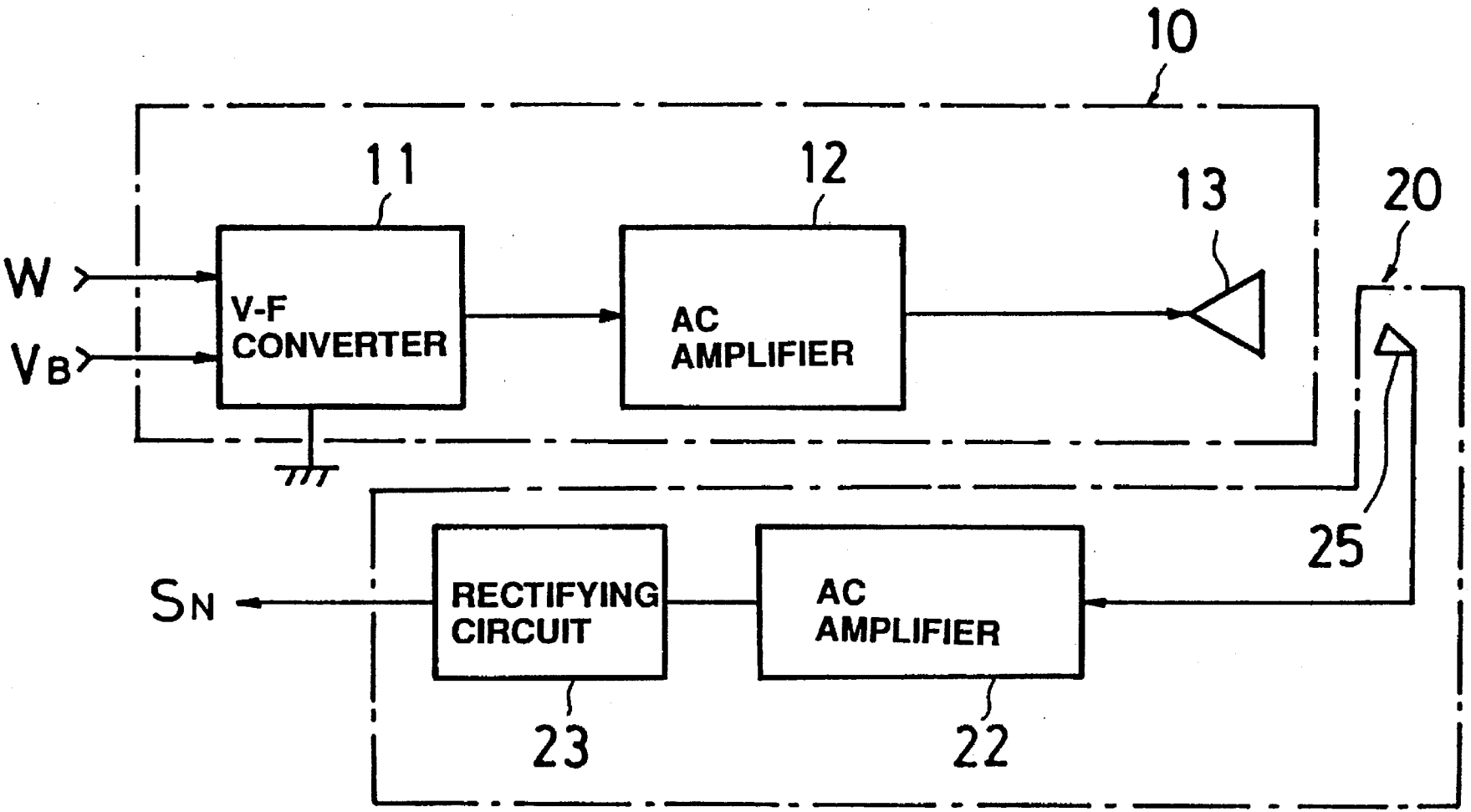
FIG. 2 is a structural diagram showing a second embodiment of a warning apparatus according to the present invention.

FIG. 2 shows a construction of a second embodiment of a warning apparatus according to the present invention. Elements the same as in FIG. 1 are indicated by the same symbols and description is omitted.

With the embodiment of FIG. 2, a microphone 25 is used instead of the current transformer 21 of the first embodiment shown in FIG. 1. More specifically the construction is such that the microphone 25 is provided close to the speaker 13, and warning sounds of an audible frequency or an inaudible frequency generated by the speaker 13 are received by the microphone 25 and converted into an electrical signal which is then sent to the AC amplifier 22.

With the embodiment of FIG. 2 also, a warning sound of an audible frequency which can be heard by personnel is generated by the speaker 13 at the time of danger, while at the time of safety, a warning sound of an inaudible frequency is generated. Hence danger can be notified without the generation of an annoying sound. Moreover if the warning sound generating circuit 10 and the monitoring circuit 20 are normal, then an output signal $S_N$ is generated by the monitoring circuit 20 due to output of the received signal from the microphone 25, while if the warning sound generating circuit 10 or the monitoring circuit 20 is faulty, an output signal $S_N$ is not generated. Hence it can be verified from the illumination or extinguishing of a lamp, whether or not these circuits are normal.

Now instead of the microphone 25, a piezoelectric element may be attached to the diaphragm of the speaker 13, so that an electrical signal is generated by the piezoelectric element corresponding to the vibration frequency of the diaphragm, and input to the AC amplifier 22. In this case also, a similar effect can be obtained.

Figure 3:
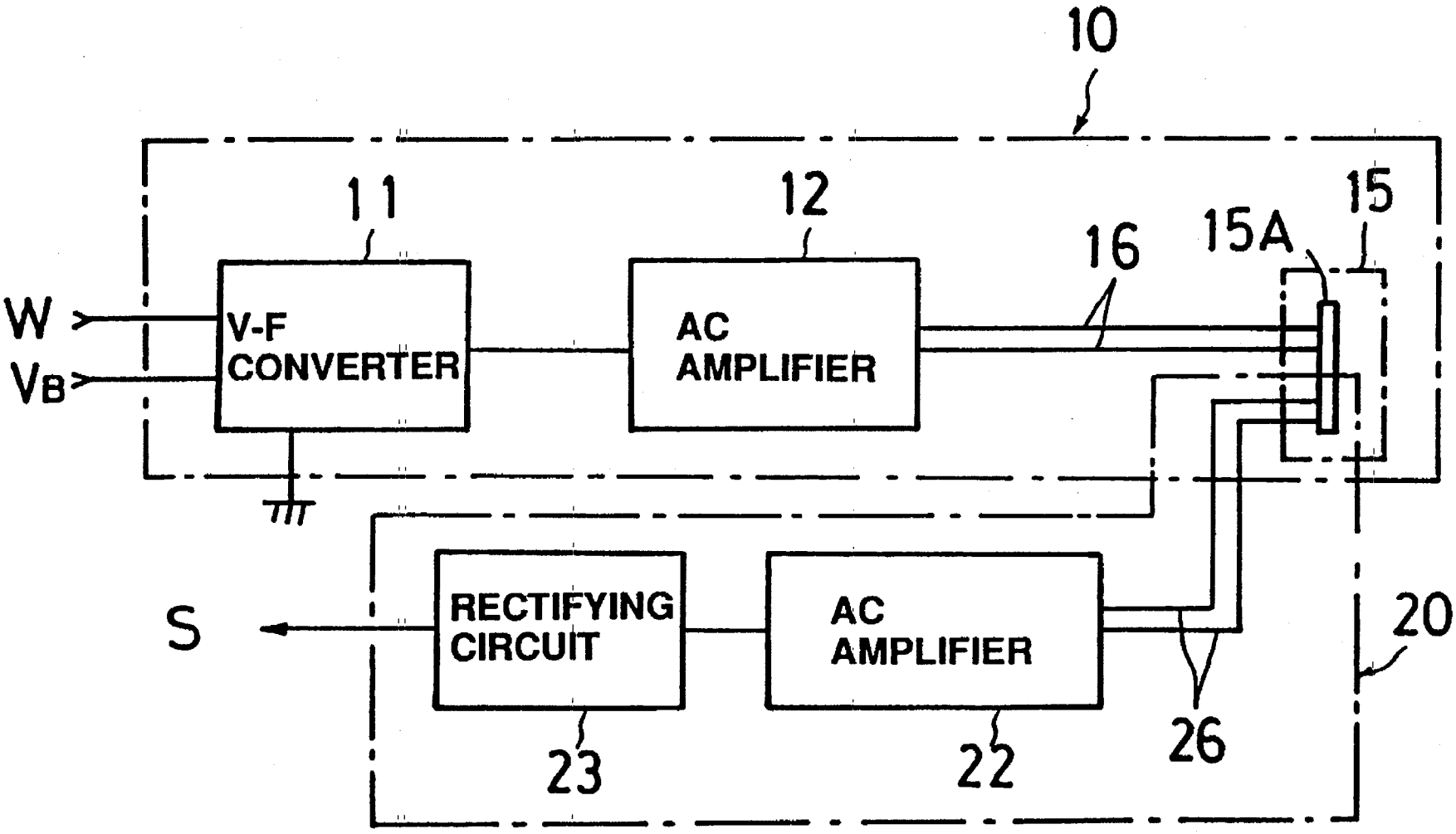
FIG. 3 is a structural diagram showing a third embodiment of a warning apparatus according to the present invention.

FIG. 3 shows a construction of a third embodiment of a warning apparatus according to the present invention. Elements the same as in FIGS. 1 and 2, are indicated by the same symbols and description is omitted.

The embodiment of FIG. 3 illustrates an example of where a piezoelectric buzzer 15 using a piezoelectric element, is used instead of the speaker 13 used in the embodiments shown in FIGS. 1 and 2.

With the third embodiment, a vibration body 15A of the piezoelectric buzzer 15 is excited by supplying an output signal from the AC amplifier 12 to the piezoelectric buzzer 15 via lead wires 16. Lead wires 26 for carrying an electrical signal to the AC amplifier 22 based on the vibration of the vibration body 15A, are connected to the vibration body 15A separate from the lead wires 16. The lead wires 26 are provided for sampling the vibration signal from the vibration body 15A, since the current driving the vibration body 15A of the piezoelectric buzzer 15 is normally a small current, and it is thus difficult to detect the current flowing in the lead wires 16 using the current transformer 21 shown in FIG. 1. With this arrangement, in a worst case scenario wherein a disconnection fault occurs in the lead wires 16 or in the lead wires 26, an input signal to the AC amplifier 22 is not generated.

With the third embodiment, when an output signal is generated by the AC amplifier 12, and the vibration body 15A thus excited, then an electrical signal is input to the AC amplifier 22 via the lead wires 26, and an output signal $S_N$ thus generated. Consequently, this embodiment also, as with the first and second embodiments, has the effect that an annoying noise is not generated at the time of safety, while when a dangerous situation arises, this can be notified to personnel, and also the normal condition of the warning sound generating circuit 10 and the monitoring circuit 20 can be verified.

When the piezoelectric buzzer 15 shown in FIG. 3 is used, a construction is possible using the microphone 25 shown in FIG. 2, with the warning sound generated by the piezoelectric buzzer 15 being received by the microphone 25 and input to the AC amplifier 22.

Figure 4:
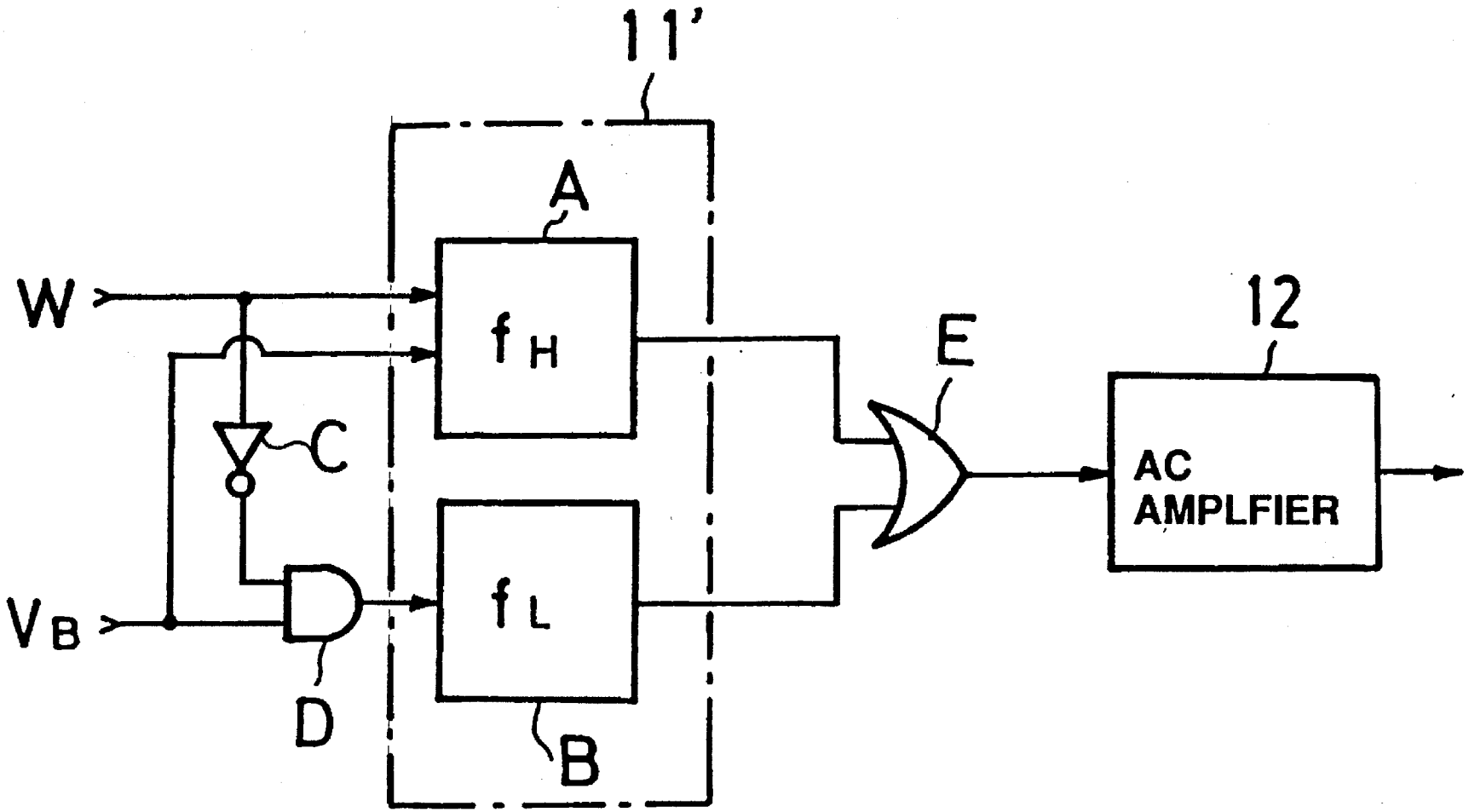
FIG. 4 is a diagram showing an example of an undesirable V-F converter configuration.

So far, such a case can be considered that the V-F converter for generating the inaudible frequency signal and the audible frequency signal comprises, as with a VF converter 11' shown in FIG. 4, a V-F converter A for generating an inaudible frequency $f_H$ and a V-F converter B for generating an audible frequency $f_L$. In this case, the construction is such that the judgement signal W and the bias voltage $V_B$ are input to the V-F converter A for generating the inaudible frequency $f_H$, and the judgement signal W is input via a NOT circuit C to an AND gate D into which the bias voltage $V_B$ is input, and the output of the logical product operation on the two inputs is input to the V-F converter B for generating the audible frequency $f_L$. The output from the V-F converters A and B is then input to the AC amplifier 12 via an OR gate E.

With such a construction, when the voltage level of the judgement signal W is a low level (when there is no judgement signal W input; indicating danger), then due to the judgement signal W being input via the NOT circuit C, the bias voltage $V_B$ is input to the V-F converter B via the AND gate D, so that a signal of an audible frequency $f_L$ is input from the V-F converter B via the OR gate E to the AC amplifier 12. As a result, a warning sound of an audible frequency can be generated from a speaker or the like at the time of danger.

On the other hand, when the voltage level of the judgement signal W is a high level (when there is an input of judgement signal W; indicating safety), then due to the judgement signal W being input via the NOT circuit C, the input of the bias voltage $V_B$ to the V-F converter B via the AND gate D is stopped, so that a signal of the audible frequency $f_L$ is not generated by the V-F converter B. However with the other V-F converter A, due to the input of the judgement signal W, a signal of an inaudible frequency $f_H$ is generated and input to the AC amplifier 12 from the OR gate E. As a result, a warning sound of an inaudible frequency can be generated from a speaker or the like at the time of safety.

However, with such a construction wherein an inaudible frequency signal and an audible frequency signal are generated using different V-F converters, since dangerous situations seldom arise, then normally only the V-F converter A which produces the inaudible frequency $f_H$ is driven. Hence it is not possible to monitor for faults in the V-F converter B which generates the audible frequency $f_L$. Consequently, in constructing the warning apparatus of the present invention, the construction must be such that both the inaudible frequency signal and the audible frequency signal are generated by a common V-F converter.

With the present invention as described above, a warning sound of an audible frequency which can be heard by personnel is generated only at the time of danger so that personnel can be warned. Moreover, the warning apparatus can be monitored as to whether or not it is normal even at the time of safety where it is not necessary to generate a warning. Hence the extremely dangerous situation wherein at the time of danger, a warning is not sounded due to a fault in the warning apparatus, can be avoided. As a result, the reliability of the warning apparatus can be increased, and the safety of operations at factories and the like can be markedly improved.

INDUSTRIAL APPLICABILITY

The present invention can continuously verify whether or not a warning apparatus is normal, thereby avoiding a situation wherein due to a fault in the warning apparatus it is not possible to warn of danger. Safety at factories and the like can thus be improved, and hence industrial applicability of the invention is considerable.

What is claimed is:

1. A warning apparatus comprising a warning sound generating circuit which generates a warning sound within an audible frequency range when a signal indicating danger is input thereto and which generates a warning sound within an inaudible frequency range when a signal indicating safety is input thereto, and a monitoring circuit for continuously monitoring for the presence of a warning sound from said warning sound generating circuit.

2. A warning apparatus according to claim 1, wherein said warning sound generating circuit comprises a voltage-frequency converter which generates an audible frequency signal when a low level voltage signal indicating danger is input thereto, and which generates an inaudible frequency signal when a high level voltage signal indicating safety is input thereto, an amplifier for amplifying an output signal from said voltage-frequency converter, and a speaker for generating a warning sound based on the output signal from said amplifier, and said monitoring circuit comprises a current sensor for detecting an input current of said speaker, an amplifier for amplifying an output from said current sensor, and a rectifying circuit for rectifying an output from said amplifier.

3. A warning apparatus according to claim 2, wherein a microphone which receives an output sound from said speaker is used instead of said current sensor.

4. A warning apparatus according to claim 2, wherein a piezoelectric buzzer is used instead of said speaker, and a microphone is used instead of said current sensor.

5. A warning apparatus according to claim 2, wherein a piezoelectric buzzer is used instead of said speaker, and instead of said current sensor, a lead wire is connected to a vibration body of said piezoelectric buzzer, and the vibration of the vibration body taken out as an electrical signal by means of said lead wire and input to an amplifier.

6. A warning apparatus according to claim 1, wherein said monitoring circuit is constructed so as to generate a high level output when there is a warning sound from said warning sound generating circuit, and a low level output when there is no warning sound.

7. A warning apparatus according to claim 2, wherein said voltage-frequency converter is constructed so as to take a previously input bias voltage, and a judgement signal being a low level voltage signal when indicating danger and a high level voltage signal when indicating safety, and with the sum of the voltage level of said judgement signal and said bias voltage as an input voltage level, generate an output signal of a frequency corresponding to said input voltage level.

* * * * *